US011469489B2

(12) United States Patent
Venkatasubramanian et al.

(10) Patent No.: US 11,469,489 B2
(45) Date of Patent: Oct. 11, 2022

(54) ANTENNA OPERABLE IN SINGLE-ENDED AND DIFFERENTIAL MODES

(71) Applicant: Bose Corporation, Framingham, MA (US)

(72) Inventors: Arun Venkatasubramanian, Singapore (SG); Hallam Arthur William Collings, Cambridgeshire (GB); Pablo Fernandez Medina, Cambridge (GB); Mohammed Alexander Shalaby, Cambridge (GB); Arpan Pal, Cambridge (GB); Emiliano Mezzarobba, Cambridge (GB); Carl Matthew Clement, Norwich (GB)

(73) Assignee: Bose Corporation, Framingham, MA (US)

( * ) Notice: Subject to any disclaimer, the term of this patent is extended or adjusted under 35 U.S.C. 154(b) by 245 days.

(21) Appl. No.: 16/860,546

(22) Filed: Apr. 28, 2020

(65) Prior Publication Data

US 2021/0336326 A1 Oct. 28, 2021

(51) Int. Cl.

| | |
|---|---|
| ***H01Q 1/12*** | (2006.01) |
| ***H01Q 1/22*** | (2006.01) |
| ***H04R 1/10*** | (2006.01) |

(52) U.S. Cl.

CPC ..... *H01Q 1/2283* (2013.01); *H04R 1/1016* (2013.01); *H04R 1/1091* (2013.01)

(58) Field of Classification Search

CPC ..... H01Q 1/273; H01Q 7/00; H01Q 9/42; H01Q 1/2233; H01Q 1/36; H01Q 9/28; H01Q 9/285; H01Q 1/2291; H01Q 1/362; H01Q 1/48; H01Q 9/26; H01Q 9/27; H01Q 1/125; H01Q 1/2283; H01Q 1/247; H01Q 1/38; H01Q 1/523; H01Q 11/08;

(Continued)

(56) References Cited

U.S. PATENT DOCUMENTS 10,412,514 B2 * 9/2019 Webster ..... H04R 25/70
10,764,666 B1 * 9/2020 Napoles ..... H01Q 7/00

(Continued)

FOREIGN PATENT DOCUMENTS

EP 3726650 A1 * 10/2020 ..... H01Q 1/273
WO WO-2021003366 A1 * 1/2021 ..... H01Q 1/273

*Primary Examiner* — Linh V Nguyen

(74) *Attorney, Agent, or Firm* — Bond, Schoeneck & King, PLLC

(57) ABSTRACT

An electrically small antenna operable in both single-ended and differential antenna systems, and corresponding circuitry configurations, is provided. The antenna may be arranged on or in a wearable audio device, such as an earbud. The antenna may include a first curved arm electrically coupled to a first port. The antenna may include a second curved arm of equal size and equal shape as the first curved arm and electrically coupled to a second port. The second curved arm may be rotationally positioned 180 degrees, relative to the first curved arm, about an imaginary axis perpendicular to a surface of the wearable audio device. The single-ended antenna system may include a radio frequency integrated circuit ("RFIC"), fixed matching network, a tuneable capacitor, and a switching circuit. The differential antenna system may include an RFIC, fixed matching network, a tuneable capacitor, and a balun.

20 Claims, 17 Drawing Sheets

(58) Field of Classification Search
CPC ..... H01Q 13/10; H01Q 21/08; H01Q 21/22; H01Q 21/30; H01Q 3/38; H01Q 5/328; H01Q 9/0421
USPC ..... 343/796, 802, 805, 842
See application file for complete search history.

(56) References Cited

U.S. PATENT DOCUMENTS

| | | | | |
|---|---|---|---|---|
| 2015/0162660 | A1* | 6/2015 | Orsi | H01Q 9/42 343/866 |
| 2016/0050502 | A1* | 2/2016 | Kvist | H04R 25/554 381/315 |
| 2017/0359645 | A1* | 12/2017 | Chen | H04R 1/1066 |
| 2019/0103661 | A1* | 4/2019 | Cousins | H01Q 1/273 |
| 2019/0190128 | A1* | 6/2019 | Shaker | H01Q 1/362 |
| 2020/0091590 | A1* | 3/2020 | Su | H01Q 9/30 |
| 2020/0136241 | A1* | 4/2020 | Shriner | H01Q 9/0421 |
| 2020/0275218 | A1* | 8/2020 | Xue | H04R 25/604 |
| 2021/0067859 | A1* | 3/2021 | Sakane | H01Q 1/273 |
| 2022/0030364 | A1* | 1/2022 | Hasani | H01Q 1/273 |

* cited by examiner

Radiation efficiency and reflection coefficient ($S_{11}$) @ 2.45 GHz

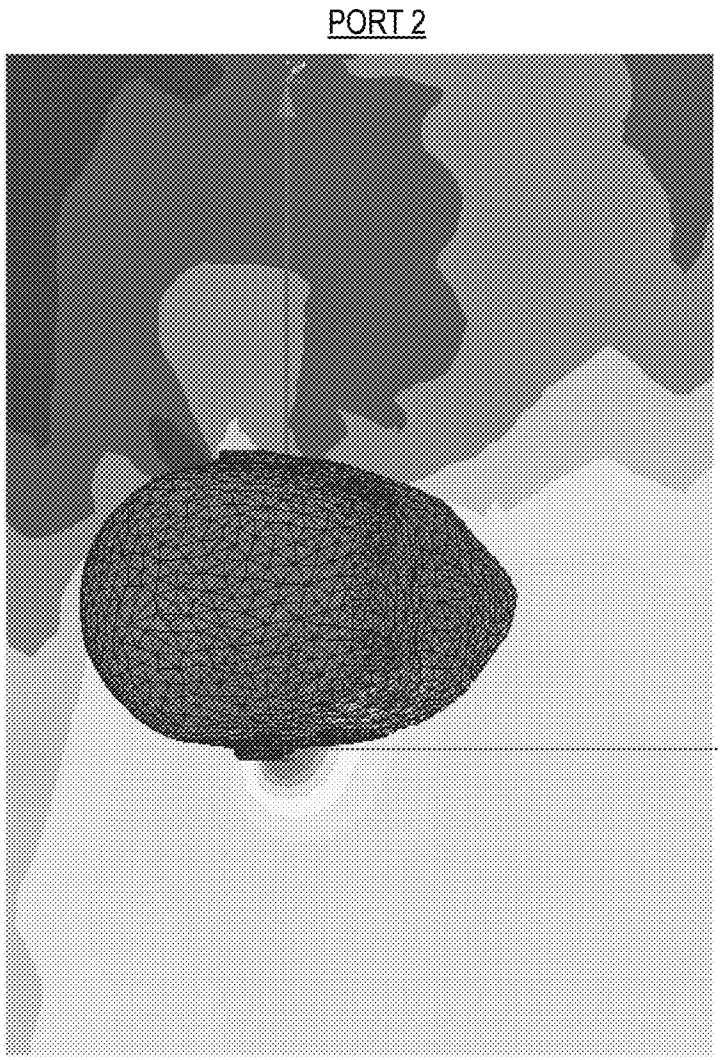
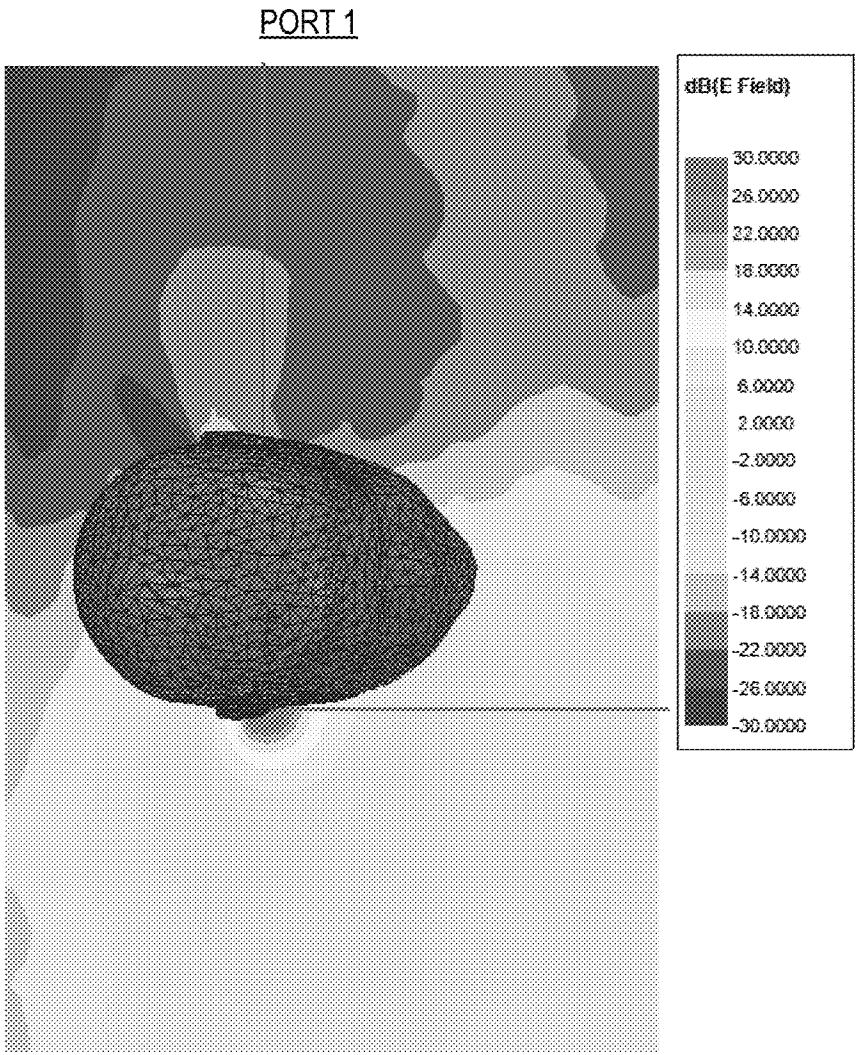
Fig. 12B
Fig. 12A

ANTENNA OPERABLE IN SINGLE-ENDED AND DIFFERENTIAL MODES

BACKGROUND

This disclosure generally relates to systems and methods for an electrically small antenna operable in both single-ended and differential modes.

SUMMARY

This disclosure generally relates to systems and methods for an electrically small antenna operable in both single-ended and differential modes.

In one aspect, an antenna may be provided. The antenna may be arranged on or in a wearable audio device. The antenna may include a first curved arm. The first curved arm may be electrically coupled to a first port. The antenna may include a second curved arm. The second curved arm may be of equal size and equal shape as the first curved arm. The second curved arm may be electrically coupled to a second port. The second curved arm may be rotationally positioned 180 degrees, relative to the first curved arm, about an imaginary axis perpendicular to a surface of the wearable audio device.

According to an example, the antenna may further include a bridge. The bridge may be electrically coupled to the first curved arm and the second curved arm. The bridge may have a minimum width less than a minimum width of the first curved arm and/or a minimum width of the second curved arm.

According to an example, the wearable audio device may be an earbud.

According to an example, the antenna may be arranged about the surface of the wearable audio device. The surface of the wearable audio device may be substantially convex.

According to an example, the antenna may be electrically small.

According to an example, the first curved arm may be electrically coupled to the first port via a first feed track. Further, the second curved arm may be electrically coupled to the second port via a second feed track. The first feed track and the second feed track may be substantially parallel.

In another aspect, a single-ended antenna system is provided. The single-ended antenna system may include the antenna described above.

The single-ended antenna system may include a radio frequency integrated circuit ("RFIC"). The RFIC may be configured to transmit or receive a radio frequency ("RF") signal via an RF port. The RFIC may be configured to provide a control logic signal via a control logic port.

The single-ended antenna system may include a fixed matching network. The fixed matching network may be electrically coupled to the RF port of the RFIC.

The single-ended antenna system may include a tuneable capacitor. The tuneable capacitor may include a first port. The tuneable capacitor may include a second port electrically coupled to ground. The tuneable capacitor may include a tuning port electrically coupled to the control logic port of the RFIC. The tuning port may be configured to receive the control logic signal.

The single-ended antenna system may include a switching circuit. The switching circuit may include a first port. The first port may be electrically coupled to the fixed matching network. The switching circuit may include a second port. The second port may be electrically coupled to the first port of the tuneable capacitor. The switching circuit may be configured to transmit or receive the RF signal via either the first port or the second port of the antenna.

According to an example, the fixed matching network may include one or more capacitors and/or one or more inductors. The fixed matching network may include one or more microstrip traces.

According to an example, the tuneable capacitor is digitally tuneable. The tuneable capacitor may be selected from a group consisting of a varicap, a switchable capacitor bank, a Micro-Electro-Mechanical Systems ("MEMS") capacitor, and combinations thereof.

According to an example, the switching circuit may be a double pole double throw ("DPDT") switch.

According to an example, the control logic signal may correspond to a desired center frequency of the monopole antenna system. The control logic signal may further correspond to a frequency tuning look-up table stored in the RFIC. The desired center frequency may be between 2.4 GHz and 2.5 GHz, inclusively.

In another aspect, a differential antenna system is provided. The differential antenna system may include the antenna described above. The differential antenna system may include an RFIC. The RFIC may be configured to transmit an RF signal via an RF port. The RFIC may be configured to provide a control logic signal via a control logic port.

The differential antenna system may include a fixed matching network. The fixed matching network may be electrically coupled to the RF port of the RFIC.

The differential antenna system may include a tuneable capacitor. The tuneable capacitor may include a first port. The first port may be electrically coupled to the fixed matching network. The tuneable capacitor may include a second port. The second port may be electrically coupled to ground. The tuneable capacitor may include a tuning port. The tuning port may be electrically coupled to the control logic port of the RFIC. The tuning port may be configured to receive the control logic signal.

The differential antenna system may include a balun. The balun may be electrically coupled to the fixed matching network. The balun may be electrically coupled to the first port of the antenna. The balun may be electrically coupled to the second port of the antenna. The balun may be configured to receive the RF signal via the fixed matching network. The balun may be configured to generate a first differential signal based on the RF signal. The first differential signal may have a first phase. The balun may be configured to generate a second differential signal based on the RF signal. The second differential signal may have a second phase. The second phase may differ from the first phase by a differential phase value. The balun may be configured to transmit the first differential signal to the first port of the antenna. The balun may be configured to transmit the second differential signal to the second port of the antenna. The differential phase value may be 180 degrees.

In another aspect, a differential antenna system is provided. The differential antenna system may include the antenna as described above. The differential antenna system may include an RFIC configured to receive an RF signal via an RF port. The differential antenna system may provide a control logic signal via a control logic port.

The differential antenna system may include a fixed matching network. The fixed matching network may be electrically coupled to the RF port of the RFIC.

The differential antenna system may include a tuneable capacitor. The tuneable capacitor may include a first port. The first port may be electrically coupled to the fixed matching network. The tuneable capacitor may include a second port. The second port may be electrically coupled to ground. The tuneable capacitor may include a tuning port. The tuning port may be electrically coupled to the control logic port of the RFIC. The tuning port may be configured to receive the control logic signal.

The differential antenna system may include a balun. The balun may be electrically coupled to the fixed matching network. The balun may be electrically coupled to the first port of the antenna. The balun may be electrically coupled to the second port of the antenna. The balun may be configured to receive a first differential signal from the first port of the antenna. The balun may be configured to receive a second differential signal from the second port of the antenna. The balun may be configured to generate the RF signal based on the first and second differential signal. The balun may be configured to transmit the RF signal to the RFIC via the fixed matching network.

Other features and advantages will be apparent from the description and the claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various examples.

FIGS. 12A and 12B are electric field simulations for the single-ended antenna system when the RF signal is applied to the first and second ports of the antenna, according to an example.

DETAILED DESCRIPTION

Figure 1:
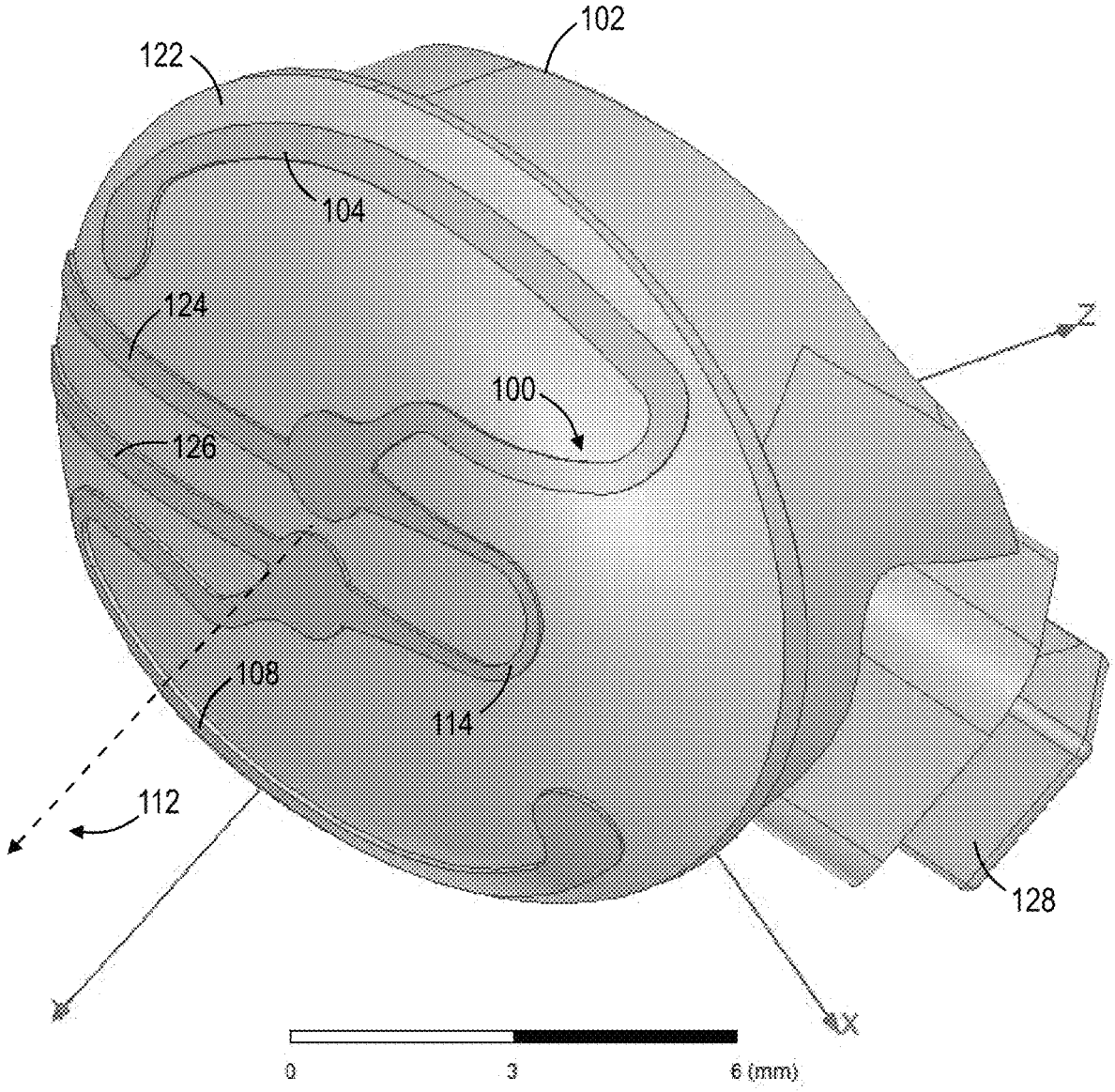
FIG. 1 is an isometric view of an antenna arranged on an earbud, according to an example.

This disclosure generally relates to systems and methods for an electrically small antenna operable in both single-ended and differential modes. The antenna is arranged on a wearable audio device, such as an earbud. The antenna includes two ports, each electrically coupled to an identical curved arm. The curved arms are rotationally arranged 180 degrees, relative to each other, about the wearable audio device. The curved arms may be connected by a bridge for impedance matching purposes. In single-ended transmit mode, a driving circuit utilizes a switching circuit to provide an RF signal to one of the ports, causing one, and only one, of the antenna arms to radiate. In this configuration, the antenna operates as a monopole. Similarly, in single-ended receive mode, the driving circuit relies on radiation received by one of the two antenna arms. The center frequency of the radiation may be adjusted by a tuneable capacitor. In a differential transmit mode, the RF signal is split into two corresponding differential signals with a relative phase shift of 180 degrees via a balun. These differential signals are then provided to the ports of the antenna, causing one arm to radiate based on one of the differential signals, and the other arm to radiate based on the other differential signal. In this configuration, the antenna operates as a dipole. Similarly, in differential receive mode, each arm receives a portion of a signal, and the portions are combined via the balun. In operation on an earbud, the single-ended mode generally provides better performance in terms of gain and reflection, but the differential mode provides more resilient performance regarding ear position. Accordingly, depending on the application, the system may generate sufficient radiation in both single-ended and differential modes without adjustments to the physical shape, size, or geometric parameters of the antenna.

The term "wearable audio device", as used in this application, is intended to mean a device that fits around, on, in, or near an ear (including open-ear audio devices worn on the head or shoulders of a user) and that radiates acoustic energy into or towards the ear. Wearable audio devices are sometimes referred to as headphones, earphones, earpieces, headsets, earbuds or sport headphones, and can be wired or wireless. A wearable audio device includes an acoustic driver to transduce audio signals to acoustic energy. The acoustic driver may be housed in an earcup. While some of the figures and descriptions following may show a single wearable audio device, having a pair of earcups (each including an acoustic driver) it should be appreciated that a wearable audio device may be a single stand-alone unit having only one earcup. Each earcup of the wearable audio device may be connected mechanically to another earcup or headphone, for example by a headband and/or by leads that conduct audio signals to an acoustic driver in the ear cup or headphone. A wearable audio device may include components for wirelessly receiving audio signals. A wearable audio device may include components of an active noise reduction (ANR) system. Wearable audio devices may also include other functionality such as a microphone so that they can function as a headset. While FIGS. 1-4 show examples of earbud form factors, in other examples the headset may be an in-ear, on-ear, around-ear, or near-ear headset. In some examples, a wearable audio device may be an open-ear device that includes an acoustic driver to radiate acoustic energy towards the ear while leaving the ear open to its environment and surroundings.

Figure 2:
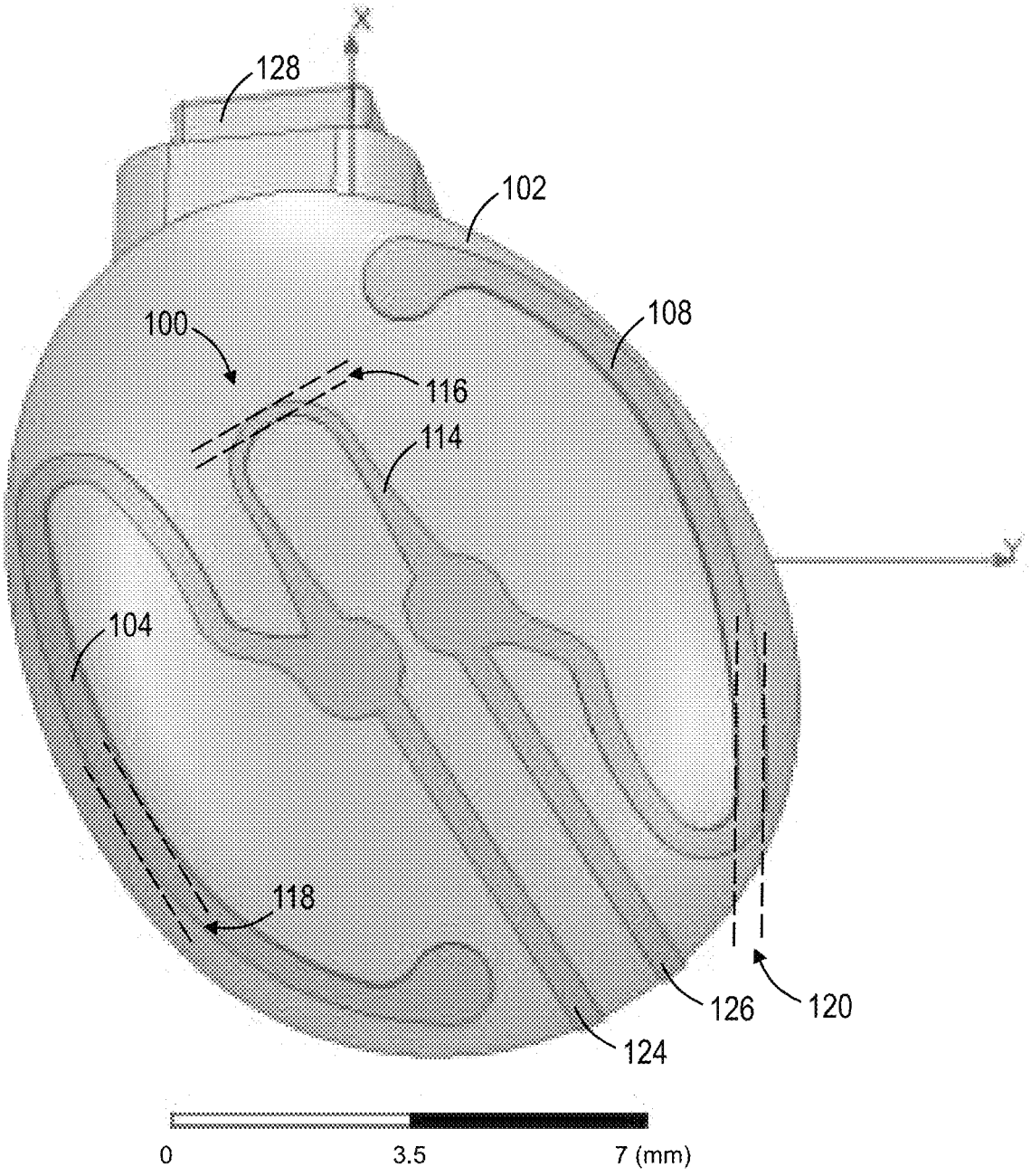
FIG. 2 is a rotated isometric view of an antenna arranged on an earbud, according to an example.
Figure 3:
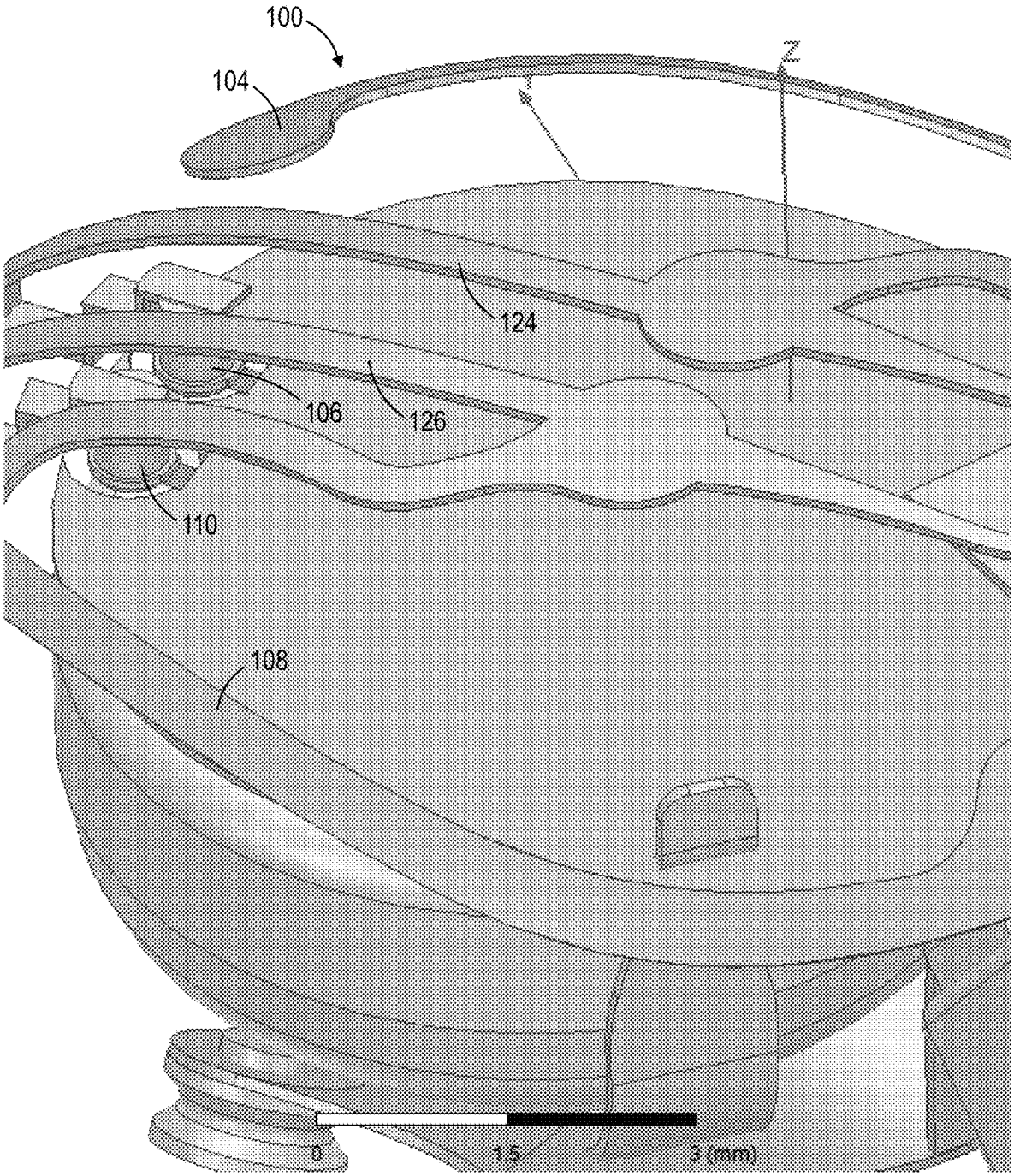
FIG. 3 is a close-up exploded view of an antenna arranged on an earbud, according to an example.

In one aspect, and with reference to FIGS. 1-3, an antenna 100 may be provided. The antenna 100 may be arranged on or in a wearable audio device 102. For example, the antenna may be configured to wirelessly transmit or receive information from a source device, such as a smartphone, personal computer, radio, portable music player, or television. The information may include audio data, such as speech or music, for the wearable audio device to transduce into audible sound pressure. The information may include commands regarding operation of the wearable audio device 102 or the source device. For example, the command from the source device may lower the volume of the sound pressure emitted by the wearable audio device 102. In a further example, the command from the source device may enable or disable the wearable audio device 102. The antenna 100 may include one or more microstrip components arranged on a printed circuit board (PCB).

According to an example, the wearable audio device 102 may be an earbud. Providing strong and consistent antenna performance on or in earbuds can be challenging due to the complex transmission losses associated with a user's body. In particular, the user's body will be highly absorbent of signals in the 2.4-2.5 GHz ISM (Industrial, Scientific, and Medical) frequency band. Further, the transmission loss may be quite sensitive to the orientation of the earbud in the ear of the user due to the directionality of the antenna. Accordingly, developing an antenna 100 which can provide consistent performance despite the orientation of the earbud in the ear calls for a design with a significant degree of flexibility. Alternatively, the antenna 100 may be configured to provide suitable performance in each ear for a symmetric pair of earbuds. In such a pair, the antenna 100 of each earbud may be configured for single-ended or differential mode, depending on the application. The antennas 100 of each symmetric earbud may be shaped in an identical, complementary, or symmetric manner.

In a further alternative, the antenna(s) 100 may be configured and/or tuned to function efficiently in a variety of earbud placements without physical modifications, such as resting on a surface (such as a tabletop), inserted into the ear of the user, or placed inside a storage case; such flexibility is not possible in current earbud designs. The antenna(s) 100 may be configured to be very robust to detuning lossy structures in close proximity to the antenna (s) 100.

The performance of the antenna 100 may be further constrained by the physical size of the earbud. This constraint often leads to the antenna 100 being electrically small, meaning the maximum dimension of the earbud antenna 100 would be enclosed by a sphere of a diameter equal to the wavelength of the signal it transmits or receives. For example, if the antenna 100 intends to transmit a 2.45 GHz signal, the wavelength of the signal is approximately 122 mm. Accordingly, an electrically small antenna operating at 2.45 GHz will be significantly smaller than 122 mm, such as 7.5 mm. Electrically small antennas may provide a number of design challenges, including impedance matching, insertion loss due to high density current, and a small antenna aperture or effective area.

The antenna 100 may include a first curved arm 104. The first curved arm 104 may be formed by a radio frequency transmission line, such as microstrip. The properties of the transmission line may be determined based on desired radiation parameters, such as signal frequency and amplitude. As shown in FIGS. 1-3, the first curved arm 104 may be substantially ear-shaped. A portion of the first curved arm 104 may be proximate to an outer edge of the wearable audio device 102. For example, and as shown in FIGS. 1-3, the first curved arm comprises an elongated portion which is arranged substantially parallel to the outer edge of the wearable 102. The first curved arm 104 may further include one or more circular portions proximate to the ends of the arm 104. The circular portions may be utilized as intersection points with the other portions of the antenna 100 such as a bridge, ports, and/or feed tracks.

As shown in FIG. 3, the first curved arm 104 may be electrically coupled to a first port 106. The first port 106 is configured to receive a signal from a signal processing circuit. This circuitry will be described in greater detail below.

The antenna may include a second curved arm 108. As shown in FIGS. 1 and 2, the second curved arm 108 may be of equal size and equal shape as the first curved arm 104. Further, as shown in FIG. 1, the second curved arm 108 may be rotationally positioned 180 degrees, relative to the first curved arm 104, about an imaginary axis 112 perpendicular to a surface 122 of the wearable audio device 102. In this way, the second curved arm 108 may be rotationally symmetric with respect to the first curved arm 104. This equal but opposite arrangement allows for the antenna 100 to selectively operate in either single-ended or differential mode without structural modifications to the antenna 100 itself. For example, in single-ended mode, the associated circuitry may drive either the first 104 or second 108 curved arm based on the position and/or orientation of the wearable 102 on the user. This configurability may be used to counteract the challenges of implementing an electrically small antenna on an earbud. In a further example, both arms 104, 108 may be driven to improve the reliance of the antenna relative to orientation of the earbud within the ear of the user.

As shown in FIG. 3, the second curved arm 108 may be electrically coupled to a second port 110. The second port 110 is configured to receive a signal from the signal processing circuit. This circuitry will be described in greater detail below.

According to an example, and with reference to FIGS. 1 and 2, the antenna 100 may further include a bridge 114. The bridge 114 may be electrically coupled to the first curved arm 104 and the second curved arm 108. The bridge 114 may be configured for impedance matching purposes relative to the other components of the antenna 100. As shown in FIG. 2, the bridge may have a minimum width 116 less than a minimum width 118 of the first curved arm 104 and/or a minimum width 120 of the second curved arm 108.

Figure 4:
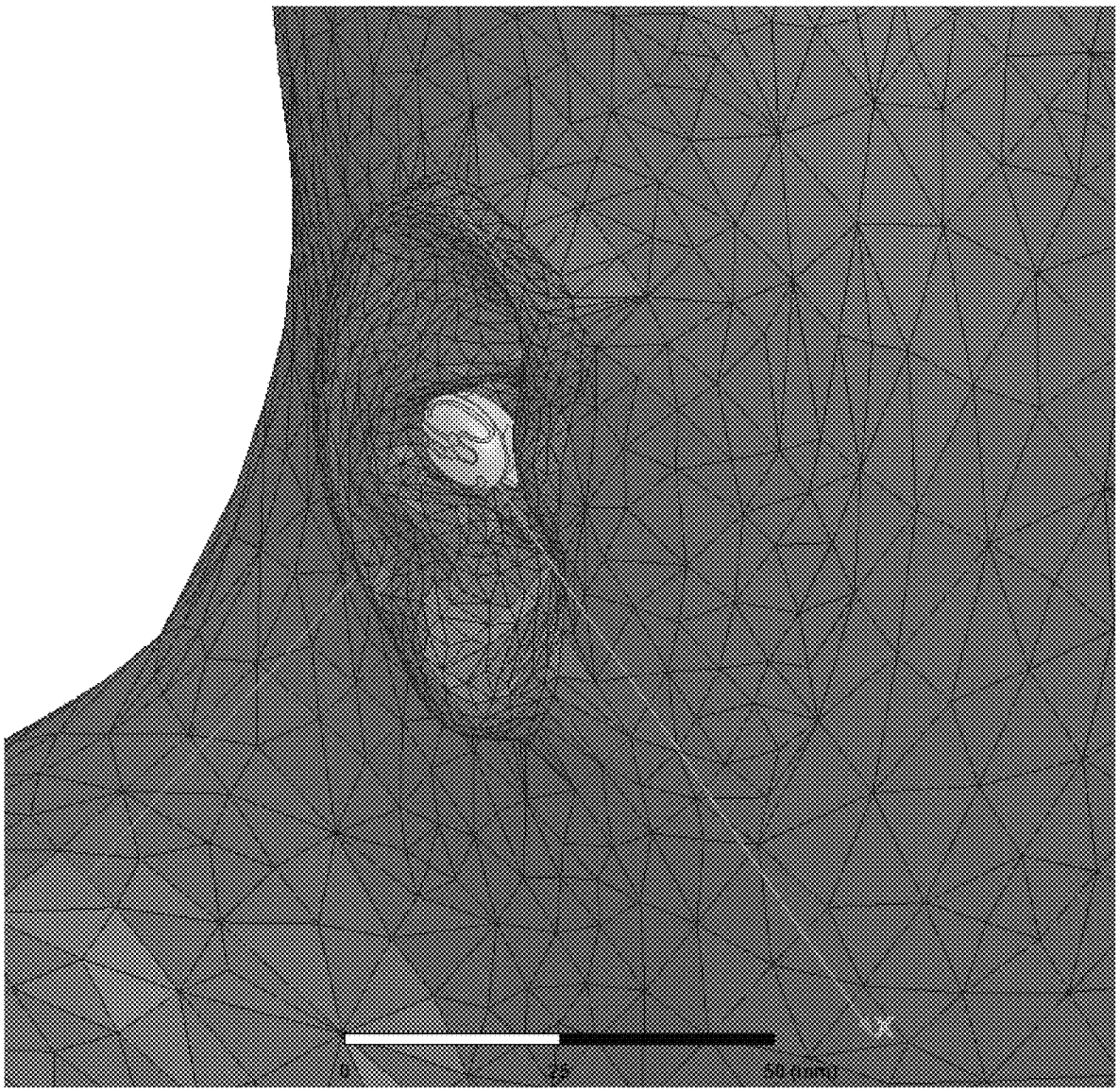
FIG. 4 is a simulated view of an antenna arranged on an earbud in a right ear of a user, according to an example.

According to an example, and as shown in FIGS. 1 and 2, the first curved arm 104 may be electrically coupled to the first port 106 via a first feed track 124. Similarly, the second curved arm 108 may be electrically coupled to the second port 110 via a second feed track 126. The first feed track 124 and the second feed track 126 may be substantially parallel. Electrical currents measured along the feed tracks 124, 126 may be higher than any other currents measured in the physical structure of the antenna 100. In an example wherein the antenna 100 is arranged on or in an earbud, the feed tracks 124, 126 may be arranged opposite of a protrusion 128 of the earbud to be inserted in or arranged proximate to the ear canal of the user. The protrusion 128 may be referred to as a "nozzle". By positioning the feed tracks 124, 126 opposite of the ear canal of the user, as can be seen in FIG. 4, the electric fields generated by antenna 100 may radiate with limited absorption due to the proximity of the user's flesh. Limiting this absorption leads to greater antenna efficiency. In some cases, the earbud may support a compliant ear tip to assist in acoustically coupling the protrusion 128 with the user's ear canal.

Figure 5:
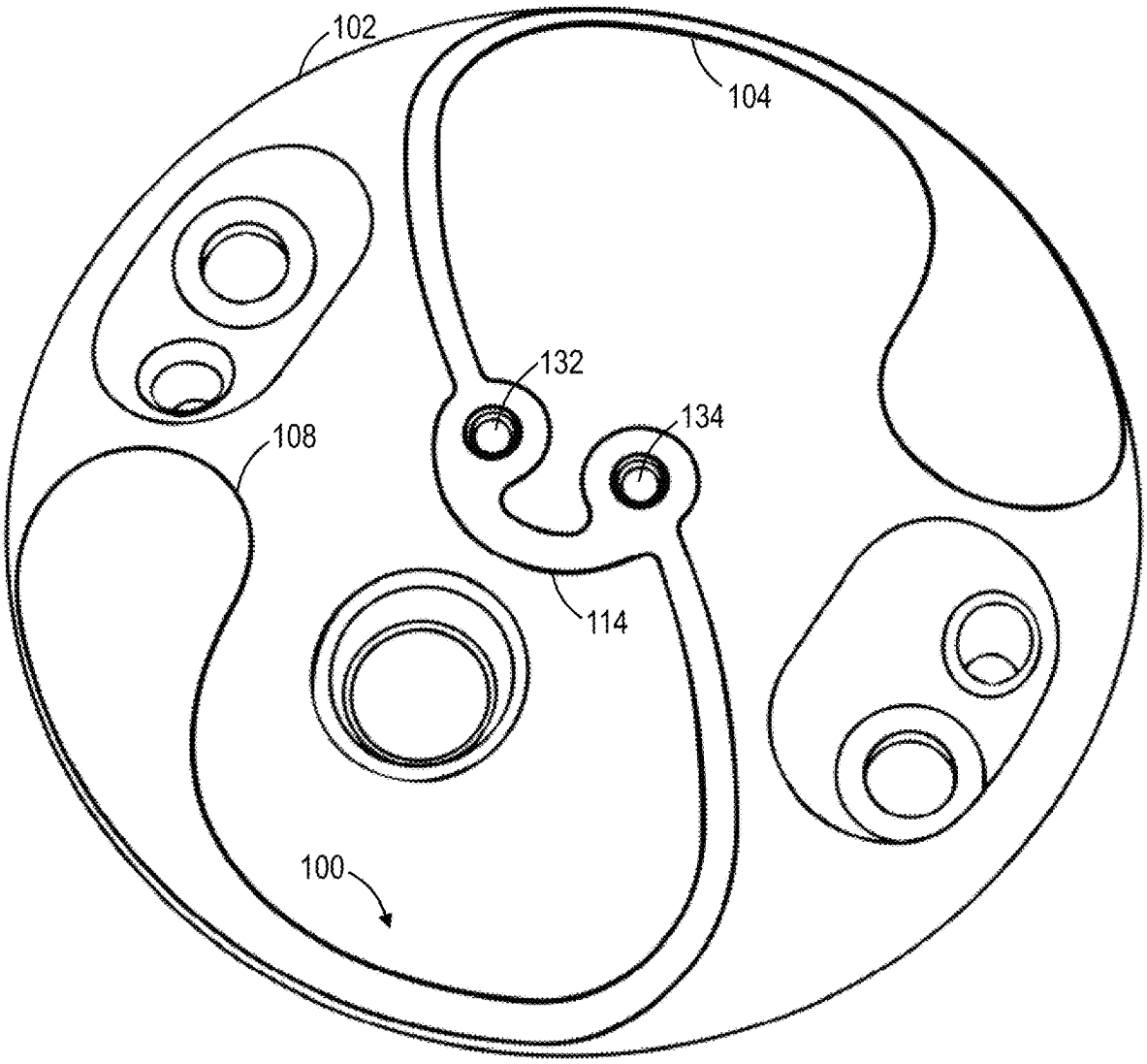
FIG. 5 is a top view of an antenna arranged on an earbud, according to an example.
Figure 6:
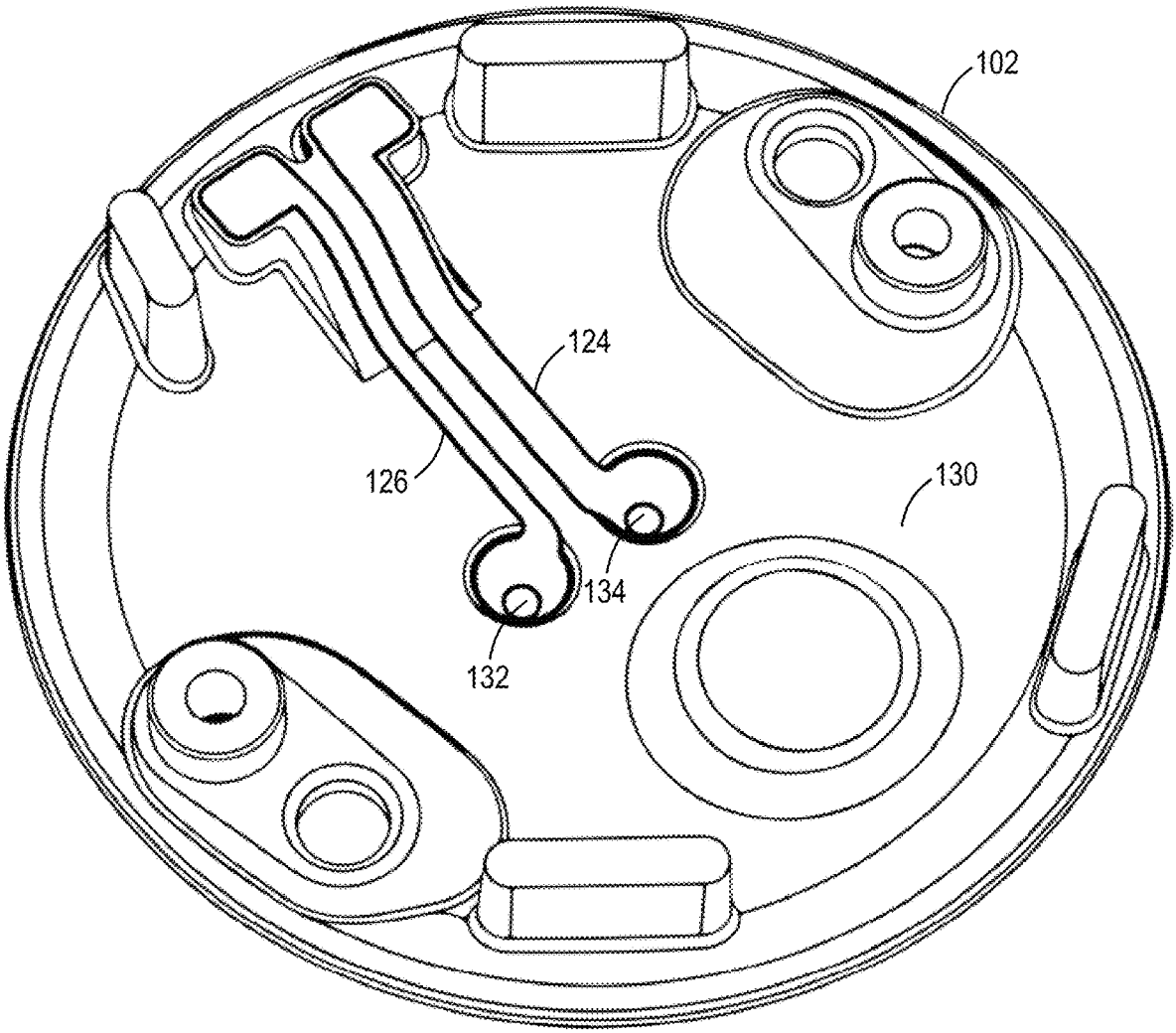
FIG. 6 is a bottom view of an antenna arranged on an earbud, according to an example.

According to an example, and as shown in FIGS. 1 and 2, the antenna 100 may be arranged about the surface 122 of the wearable audio device 102. In this arrangement, the microstrip components of the antenna, and their PCB, may bend or flex relative to the surface 122. As shown in FIGS. 1 and 2, the surface 122 of the wearable audio device 102 may be substantially convex. Depending on the implementation of the antenna 100, the first 104 and second 108 curved arms may be arranged on the top or bottom of the device 102. Further, the first 124 and second 126 feed tracks may also be arranged on the top or bottom of the device 102. As shown in FIGS. 1-4, the curved arms 104, 108 may be arranged on the same side of the device 102 as the feed tracks 124, 126. In a further example, and as shown in FIGS. 5 and 6, the curved arms 104, 108 may be arranged on the opposite side of the device 102 as the feed tracks 124, 126. In this example, and as shown in FIG. 6, feed tracks 124, 126 are arranged on the inner wall 130 of the device 102. The feed tracks 124, 126 may be connected to curved arms 104, 108 by through hole vias (virtual interconnect access) 132, 134. The through hole vias 132, 134 may be plated.

Figure 7:
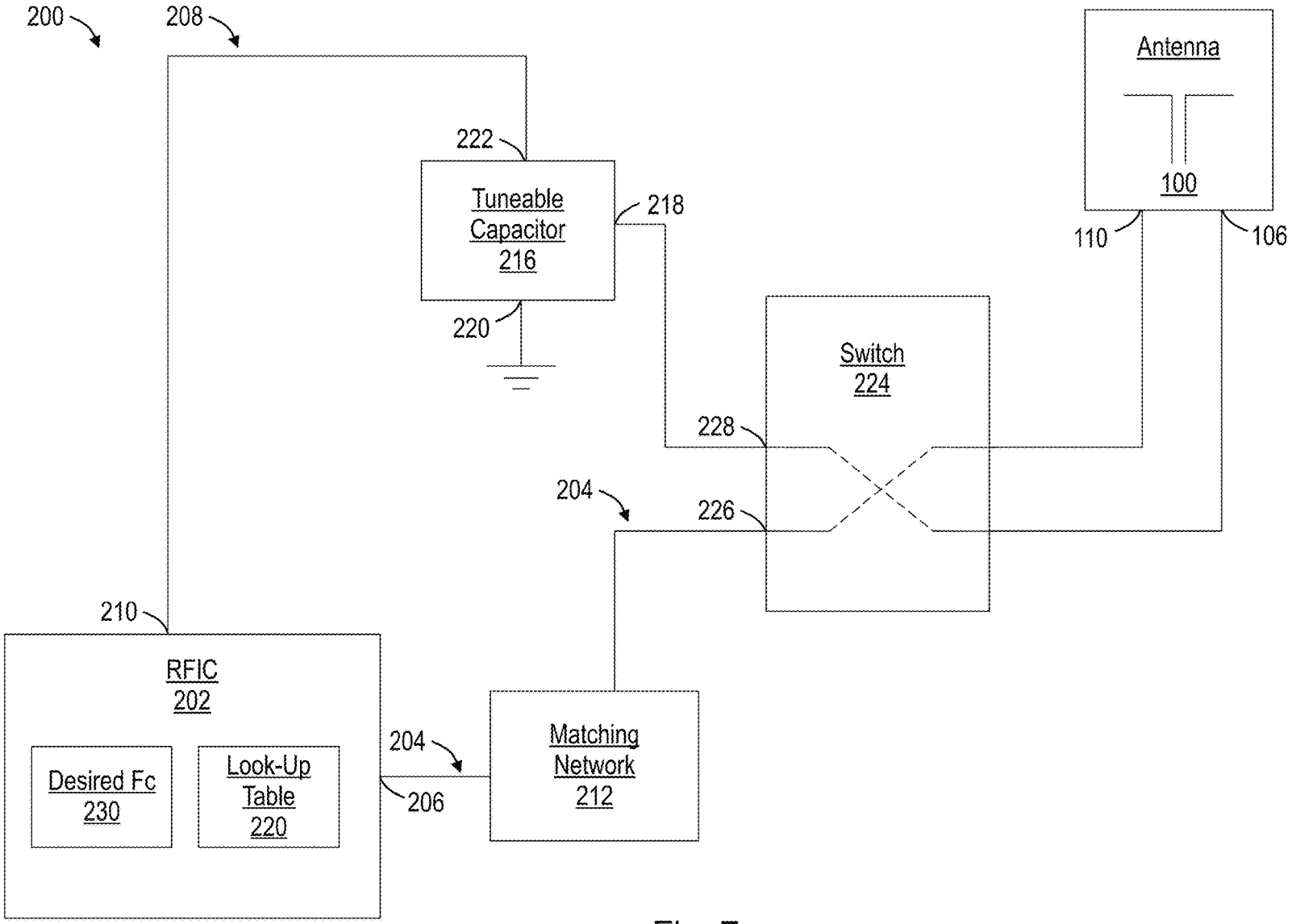
FIG. 7 is a simplified schematic of a single-ended antenna system, according to an example.

In another aspect, and with reference to the schematic shown in FIG. 7, a single-ended antenna system 200 is provided. The single-ended antenna system 200 may include the antenna 100 described above. The single-ended antenna system 200 may be configured to transmit or receive wireless signals. The single-ended antenna system 200 may be configured to be unidirectional or bidirectional.

The single-ended antenna system 200 may include a radio frequency integrated circuit ("RFIC") 202. The RFIC 202 may be configured to transmit or receive a radio frequency ("RF") signal 204 via an RF port 206. The RF signal 204 will correspond to the signal transmitted or received by the antenna 100. In the transmit mode, the RFIC 202 may be provided with a signal from the internal circuitry of the wearable 102. For instance, in transmit mode, the RF signal 204 may include data regarding the wearable 102, such as battery life or volume. In a further example, the RF signal 204 may include one or more commands for the source device to power on or off. In receive mode, the RF signal 204 may include audio data, such as speech or music, for the wearable audio device 102 to transduce into audible sound pressure. The RF signal 204 may include commands regarding operation of the wearable audio device 102. For example, the command from the source device may lower the volume of the sound pressure emitted by the wearable audio device 102. In a further example, the command from the source device may enable or disable the wearable audio device 102.

The RFIC 202 may be configured to provide a control logic signal 208 via a control logic port 210. As will be described below, the RFIC 202 utilizes the control logic signal 208 to fine-tune the preferred transmit or receive frequency of the system 200.

With reference to FIG. 7, the single-ended antenna system 200 may include a fixed matching network 212. The fixed matching network 212 may be electrically coupled to the RF port 206 of the RFIC 202. The fixed matching network 212 may be configured to impedance match the output impedance of the RF port 206 to the input impedance of the switch 224. According to an example, the fixed matching network 212 may include one or more capacitors, one or more inductors, and/or one or more resistors. The fixed matching 212 network may include one or more microstrip traces.

With further reference to FIG. 7, the single-ended antenna system 200 may include a tuneable capacitor 216. The tuneable capacitor 216 may include a first port 218. The tuneable capacitor 216 may include a second port 220 electrically coupled to ground. The tuneable capacitor 216 may include a tuning port 222 electrically coupled to the control logic port 210 of the RFIC 202. The tuning port 222 may be configured to receive the control logic signal 208 provided by the RFIC 202.

Figure 8:
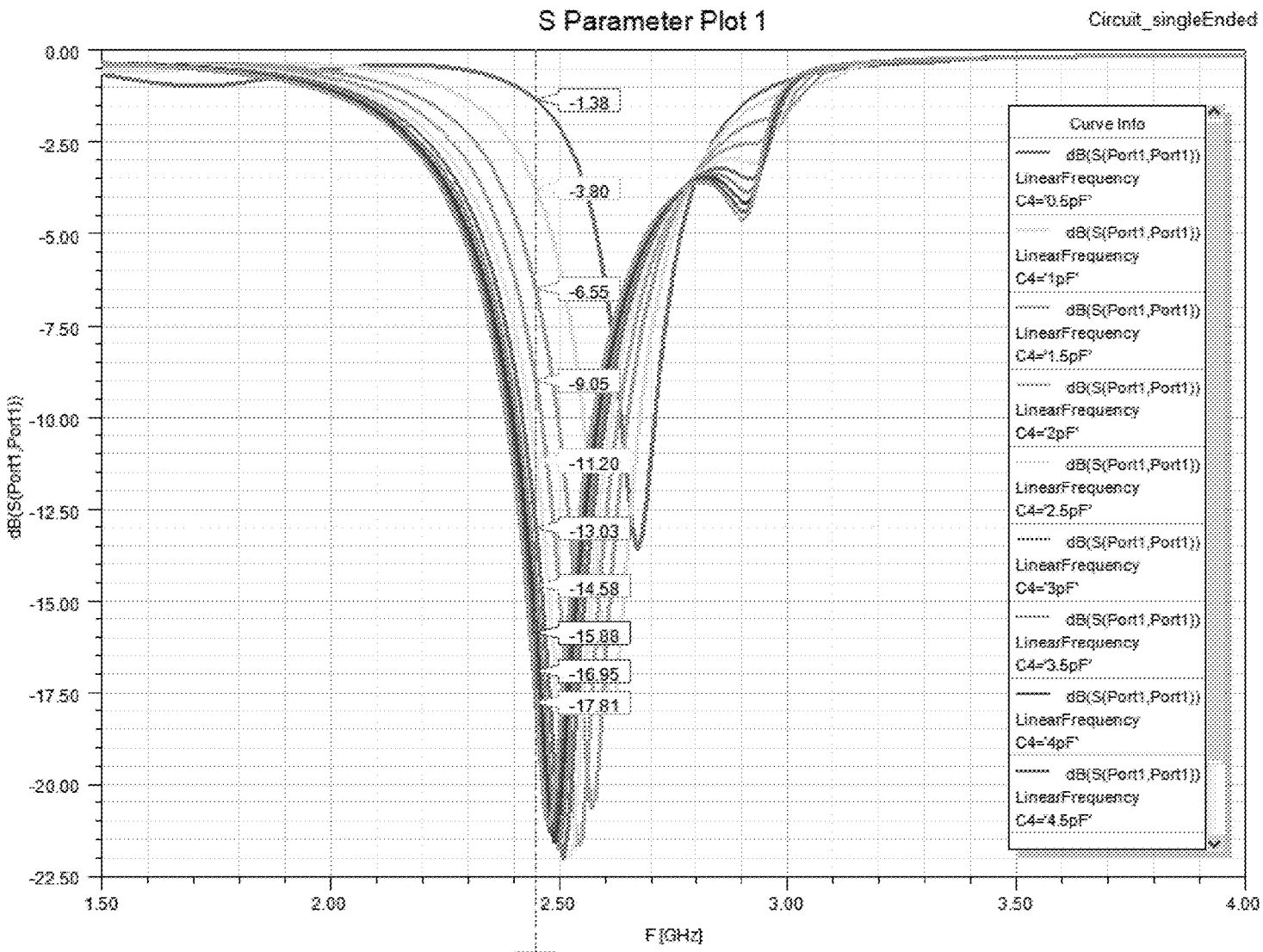
FIG. 8 is an s-parameter reflection simulation plot for a single-ended antenna system utilizing a range of tuneable capacitance values, according to an example.
Figure 9:
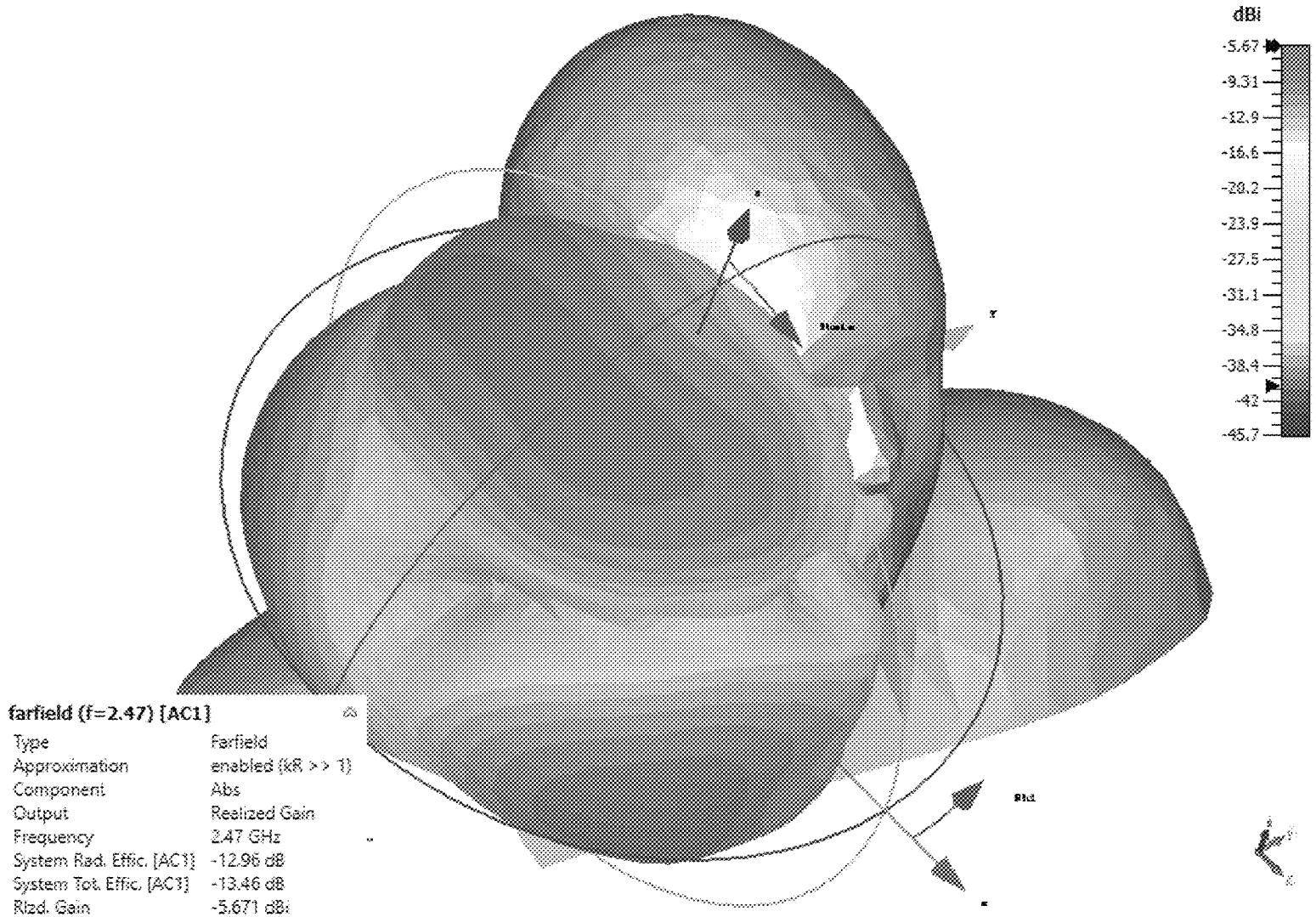
FIG. 9 is a simulated heatmap of radiation produced by the single-ended antenna system when an RF signal is applied to the first port of the antenna, according to an example.
Figure 10:
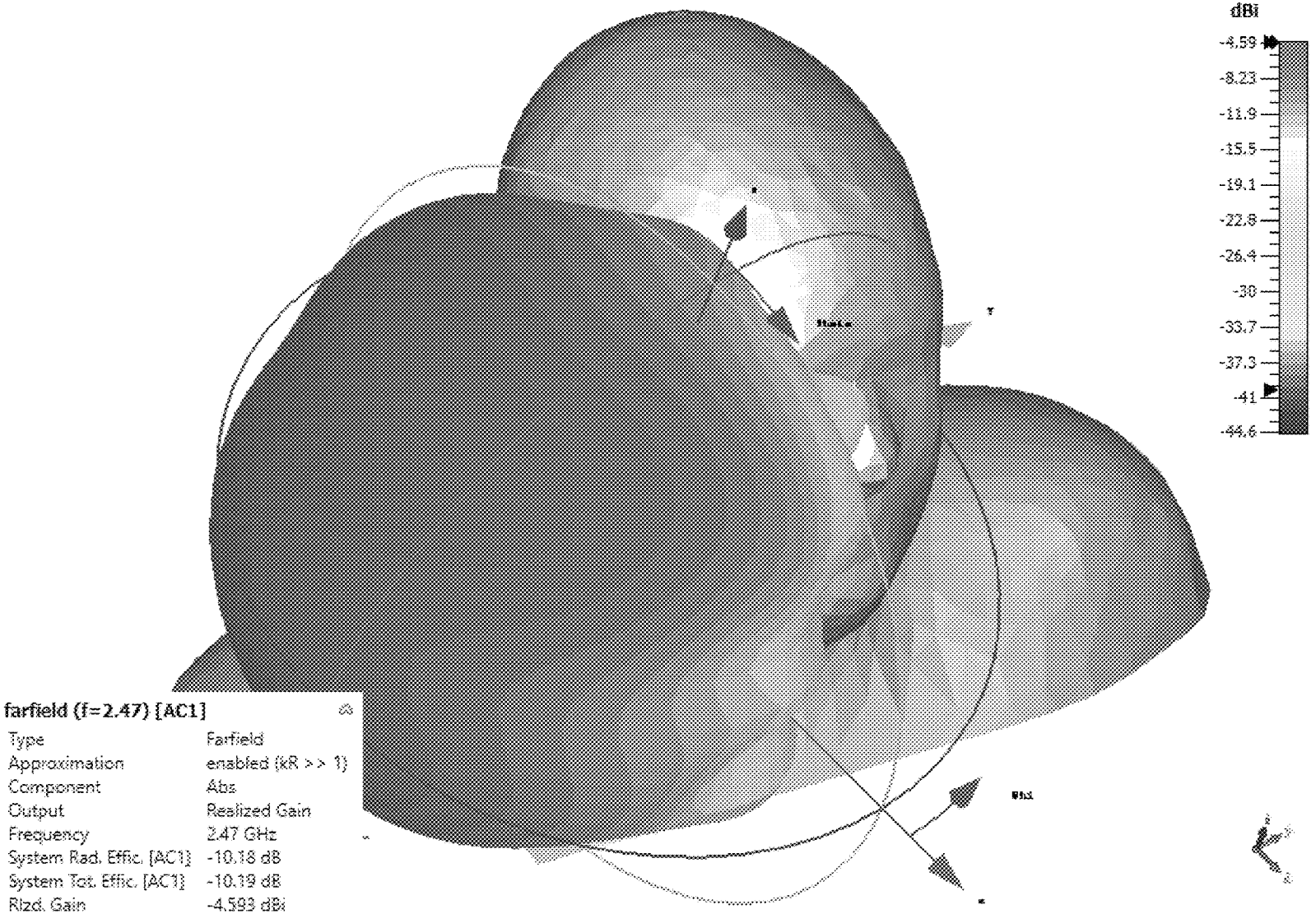
FIG. 10 is a simulated heatmap of radiation produced by the single-ended antenna system when an RF signal is applied to the second port of the antenna, according to an example.
Figure 11A:
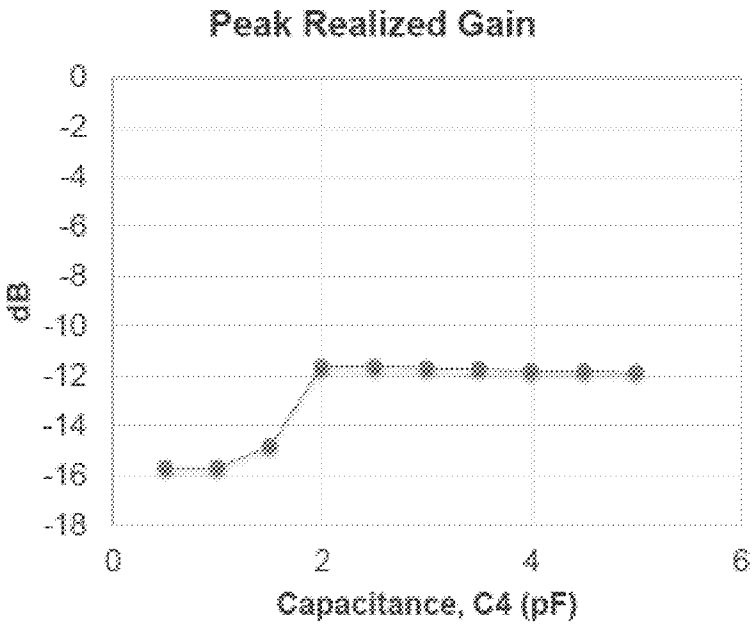
FIGS. 11A and 11B are s-parameter gain and reflection simulation plots, respectively, for the single-ended antenna system operating at 2.45 GHz utilizing a range of tuneable capacitance values, according to an example.
Figure 11B:
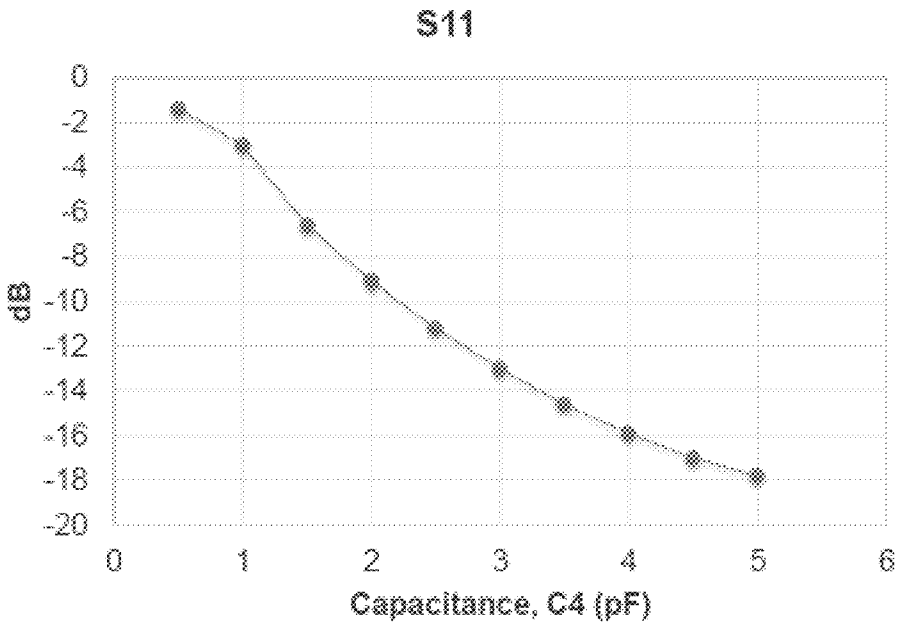

The RFIC 202 utilizes the control logic signal 208 to fine tune the frequency response of the antenna system 200 by adjusting the capacitance value of the tuneable capacitor 216. By adjusting the tuneable capacitor 216, the impedance of the circuit transmitting the RF signal 204 to, or receiving the RF signal 204 from, the antenna 100 is also adjusted. The result of this fine tuning is demonstrated by the s-parameter plot of FIG. 8. FIG. 8 shows how adjusting the value of the tuneable capacitor from 0.5 to 5 pF adjusts the amount of signal sent to the port 106 of the antenna 100 is reflected, and not transmitted by the antenna 100. As shown in FIG. 8, the reflections are minimized at 2.45 GHz by using a tuneable capacitance value of 5 pF, resulting in a reflection of 17.81 dB.

Accordingly, the RFIC 202 may utilize the control logic signal 208 to set a desired center frequency 230 of the system 200. The RFIC 202 may set the control logic signal 208 based on a frequency tuning look-up table 220 stored in the RFIC 202. The look-up table 220 may contain tuneable capacitance values known to correspond with desired center frequencies 230. The values of the desired center frequency 230 and the look-up table 220 may be stored in a memory of the RFIC 202. They may also be stored in any internal or external manner, relative to the system 200, such that they may be accessed by the RFIC 202 to configure the control logic signal 208. According to an example, the desired center frequency may be between 2.4 GHz and 2.5 GHz, inclusively, to correspond with the 2.4-2.5 GHz ISM frequency band.

According to an example, the tuneable capacitor 216 may be tuneable via a digital or analog signal. The tuneable capacitor 216 may be selected from a group consisting of a varicap, a switchable capacitor bank, a Micro-Electro-Mechanical Systems ("MEMS") capacitor, and combinations thereof.

With continued reference to FIG. 7, the single-ended antenna system 200 may include a switching circuit 224. The switching circuit controls which arm 104, 108 of the antenna 100 is connected to the rest of the system 200. The switching circuit 224 may include a first port 226. The first port 226 may be electrically coupled to the fixed matching network 212. The switching circuit 224 may include a second port 228. The second port 228 may be electrically coupled to the first port 218 of the tuneable capacitor 216. The second port 228 may be configured to transmit or receive the RF signal 204 via one of the first port 226 or second port 228 of the antenna. The orientation of the switching circuit 224 may be set during manufacturing, or it may be programmable by a user or technician. Further, the orientation of the switching circuit 224 may be set automatically by a controller and/or processor based on the position of the earbud in the ear of the user.

According to an example, the switching circuit 224 may be a double pole double throw (DPDT) switch. In this configuration, when the first port 226 of the switching circuit 224, coupled to the matching network 212, is coupled to the first port 106 of the antenna 100, the second port 110 of the antenna 100 couples to the first port 218 of the tuneable capacitor 216. Accordingly, in this configuration, the first arm 104 of the antenna is connected to the other components of the system 200 to transmit or receive the RF signal 204. When the switch 224 is flipped, first port 226 of the switching circuit 224 couples to the second port 110 of the antenna 100, and the second port 228 of the switching circuit 224 couples to the first port 106 of the antenna 100, resulting in the second arm 110 of the antenna 100 connecting to the other components of the system 200 to transmit or receive the RF signal 204.

Additional simulation results of the system 200 are shown in FIGS. 9-12B. FIGS. 9, 10, 12A, and 12B show how the electric field transmitted by the antenna 100 may be adjusted through the selection of the arm of the antenna 100. FIGS. 11A and 11B show the simulated radiation efficiency and reflection coefficient of the system 200 as a function of the capacitance of the tuneable capacitor 216. As shown in FIGS. 11A and 11B, the radiation efficiency of the system 200 is relatively stable between 2 pF and 5 pF, while the reflection decreases, approximately linearly, as capacitance increases.

Figure 13:
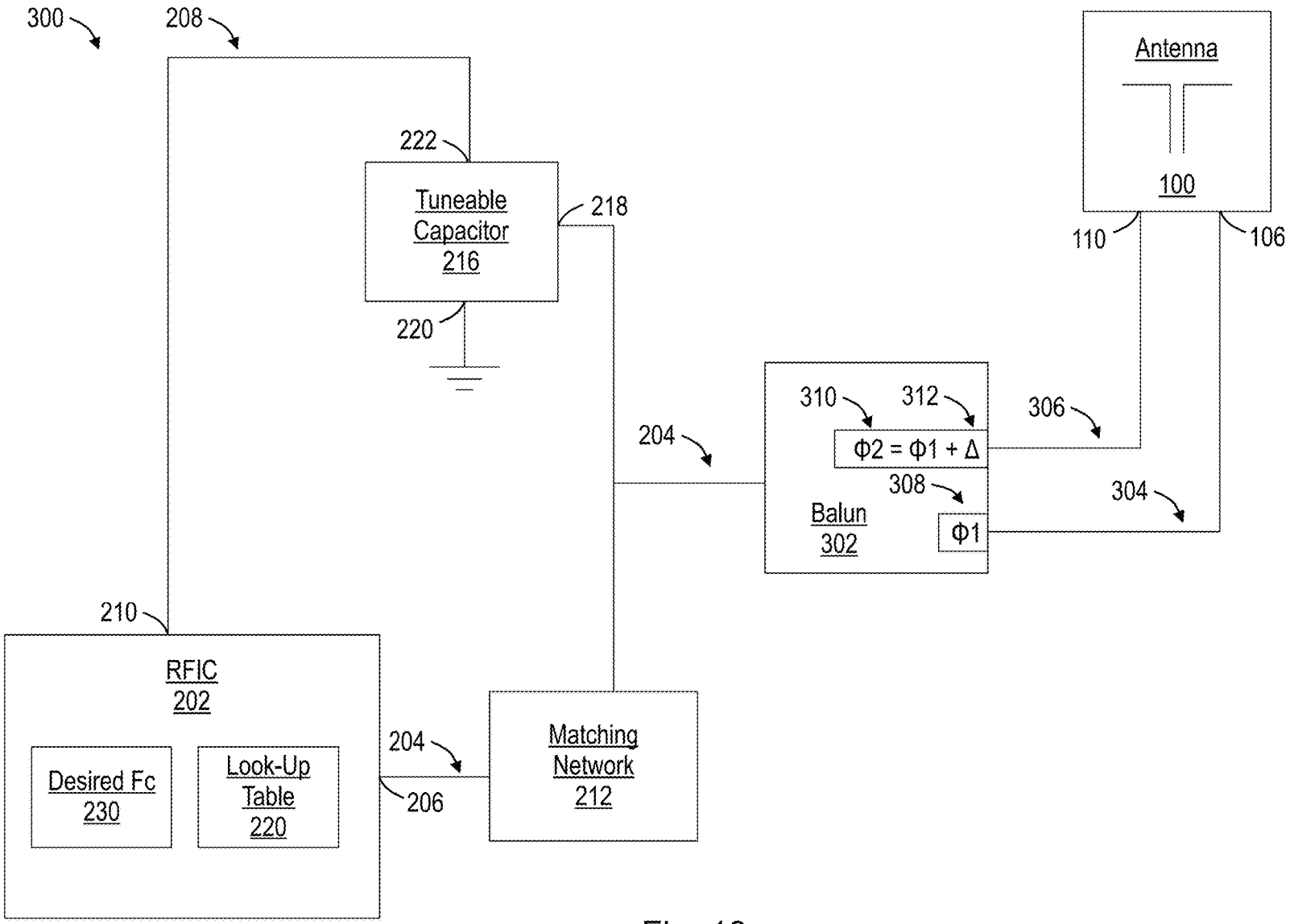
FIG. 13 is a simplified schematic of a differential antenna system, according to an example.

In another aspect, and with reference to the schematic FIG. 13, a differential antenna system 300 is provided. This differential antenna system 300 is configured to transmit an RF signal 204 via antenna 100. A complementary receive configuration is described below. The differential antenna system 300 may include the antenna 100 described above.

The differential antenna system 300 may include an RFIC 202. The RFIC 202 may be configured to transmit an RF signal 204 via an RF port 210. The RFIC 202 may be configured to provide a control logic signal 208 via a control logic port 210 in a similar manner as described in the single-ended antenna system 200 above.

The differential antenna system 300 may include a fixed matching network 212. The fixed matching network 212 may be electrically coupled to the RF port 206 of the RFIC 202. The fixed matching network 212 may be configured in a similar manner as described in the single-ended antenna system 200 above.

The differential antenna system 300 may include a tuneable capacitor 216. The tuneable capacitor 216 may include a first port 218. The first port 218 may be electrically coupled to the fixed matching network 212. The tuneable capacitor 216 may include a second port 220. The second port 220 may be electrically coupled to ground. The tuneable capacitor 216 may include a tuning port 222. The tuning port 222 may be electrically coupled to the control logic port 210 of the RFIC 202. The tuning port 222 may be configured to receive the control logic signal 208. The tuneable capacitor 216 and the control logic signal 208 controlling it may be configured in a similar manner as described in the single-ended antenna system 200 above.

With reference to FIG. 13, the differential antenna system 300 may include a balun 302. In the transmit mode, the balun 302 is configured to produce two phase-shifted signals from the RF signal 204, one for each arm 104, 108 of the antenna 100. The balun 302 may be electrically coupled to the fixed matching network 212. The balun 302 may be electrically coupled to the first port 106 of the antenna 100. The balun 302 may be electrically coupled to the second port 110 of the antenna 100. The balun 302 may be configured to receive the RF signal 204 via the fixed matching network 212.

The balun 302 may be configured to generate a first differential signal 304 based on the RF signal 204. The first differential signal 304 may have a first phase 308. This first phase 308 is designated in FIG. 13 as $\Phi_1$. The balun 302 may be configured to generate a second differential signal 306 based on the RF signal 204. The second differential signal 306 may have a second phase 310. This second phase 310 is designated in FIG. 13 as $\Phi_2$. The second phase 310 may differ from the first phase 308 by a differential phase value 312. This differential phase value 312 is designated in FIG. 13 as A. Accordingly, the second phase 310 may be calculated by the formula $\Phi_2=\Phi_1+\Delta$. The differential phase value A may be 180 degrees. The first 304 and second 306 differential signals may have equal amplitude. The amplitude of the first 304 and second differential 306 signals may be less than the amplitude of the RF signal 204.

The balun 302 may be configured to transmit the first differential signal 304 to the first port 106 of the antenna 100. The balun 302 may be configured to transmit the second differential signal 306 to the second port 110 of the antenna 100. Thus, the second arm 108 of the antenna 100 may radiate the second differential signal 306 of equal amplitude as and 180 degrees out-of-phase from the first differential signal 304. This phase shift limits destructive interference between the radiation from the first 104 and second 108 arms of the antenna 100.

In another aspect, and with further reference to the schematic of FIG. 13, a differential antenna system 300 is provided. This differential antenna system 300 is configured to receive an RF signal 204 via antenna 100. The differential antenna system 300 may include the antenna 100 as described above. The differential antenna system 300 may include an RFIC 200 configured to receive an RF signal 204 via an RF port 206. The RFIC 202 may be configured to provide a control logic signal 208 via a control logic port 210 in a similar manner as described in the single-ended antenna system 200 above.

The differential antenna system 300 may include a fixed matching network 212. The fixed matching network 212 may be electrically coupled to the RF port 206 of the RFIC 202. The fixed matching network 212 may be configured in a similar manner as described in the single-ended antenna system 200 above.

The differential antenna system 300 may include a tuneable capacitor 216. The tuneable capacitor 216 may include a first port 218. The first port 218 may be electrically coupled to the fixed matching network 212. The tuneable capacitor 216 may include a second port 220. The second port 220 may be electrically coupled to ground. The tuneable capacitor 216 may include a tuning port 222. The tuning port 222 may be electrically coupled to the control logic port 210 of the RFIC 202. The tuning port 222 may be configured to receive the control logic signal 208. The tuneable capacitor 216 and the control logic signal 208 controlling it may be configured in a similar manner as described in the single-ended antenna system 200 above.

The differential antenna system 300 may include a balun 302. In the receive mode, the balun 302 may be configured to combine the radiation intercepted by the arms 104, 108 of the antenna 100 into a single RF signal 204 to be received by the RFIC 202. The balun 302 may be electrically coupled to the fixed matching network 212. The balun 302 may be electrically coupled to the first port 106 of the antenna 100. The balun 302 may be electrically coupled to the second port 110 of the antenna 100. The balun 302 may be configured to receive a first differential signal 304 from the first port 106 of the antenna 100. The balun 302 may be configured to receive a second differential signal 306 from the second port 110 of the antenna 100. The balun 302 may be configured to generate the RF signal 204 based on the first 304 and second 306 differential signal. The balun 302 may be configured to transmit the RF signal 204 to the RFIC 202 via the fixed matching network 212.

Figure 14:
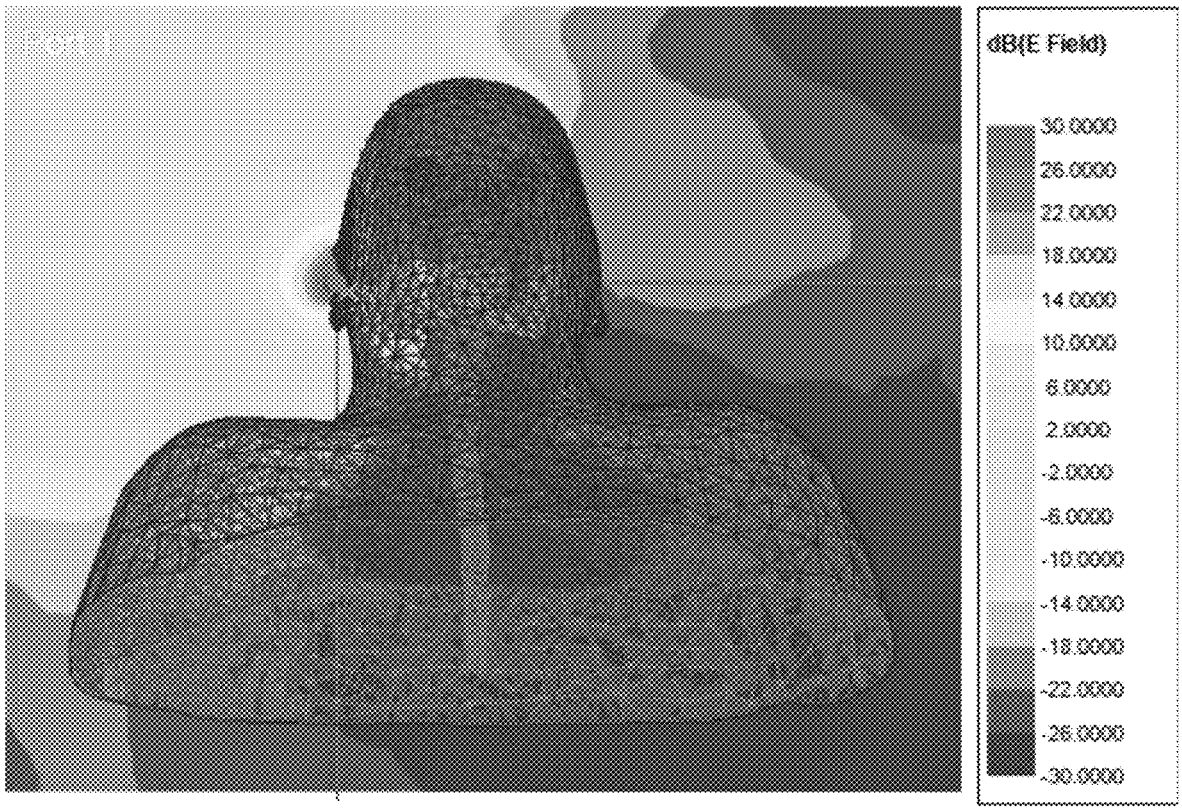
FIG. 14 is an electric field simulation for the differential antenna system, according to an example.
Figure 15:
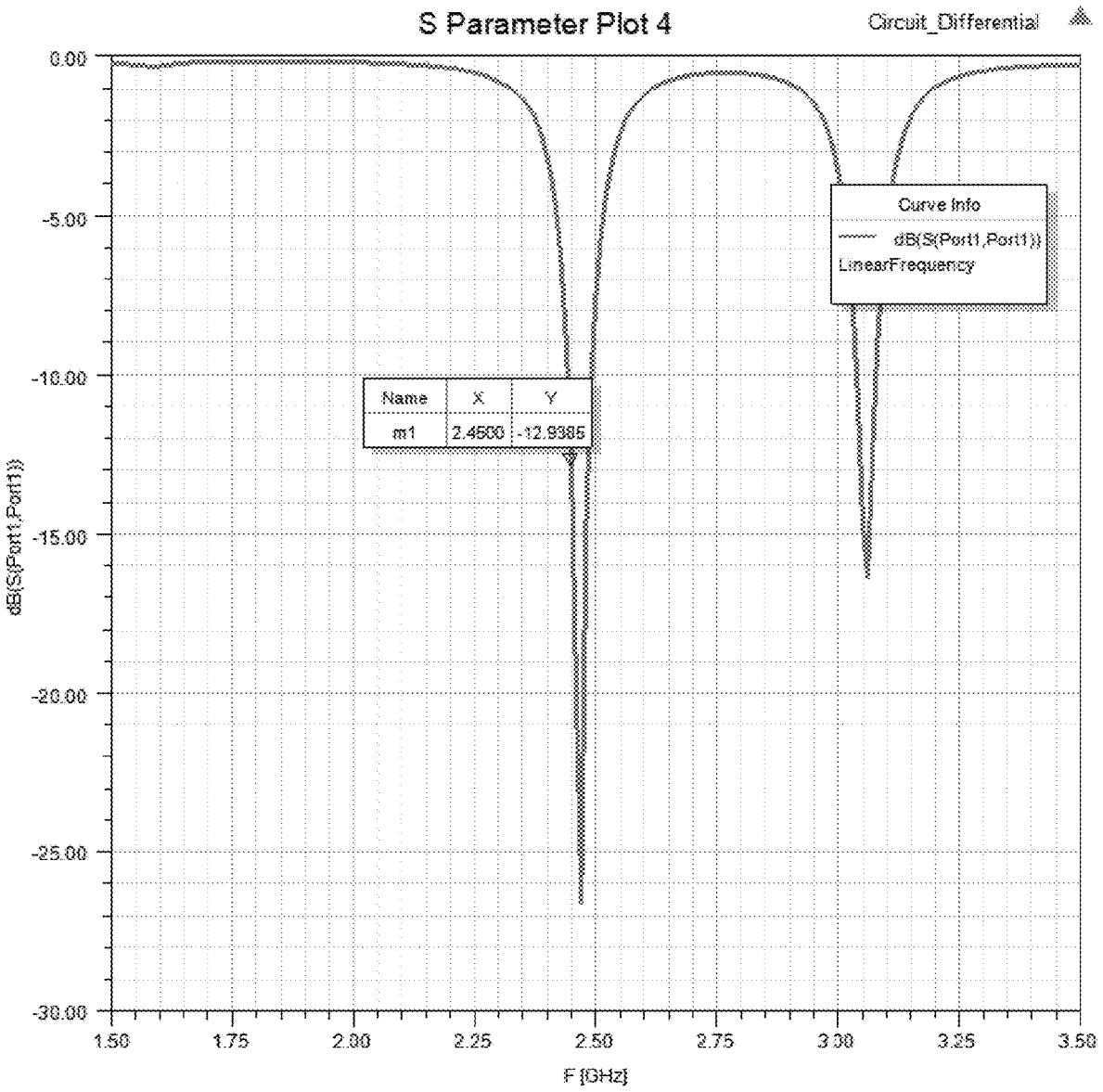
FIG. 15 is an s-parameter reflection simulation plot for a differential antenna system, according to an example.
Figure 16:
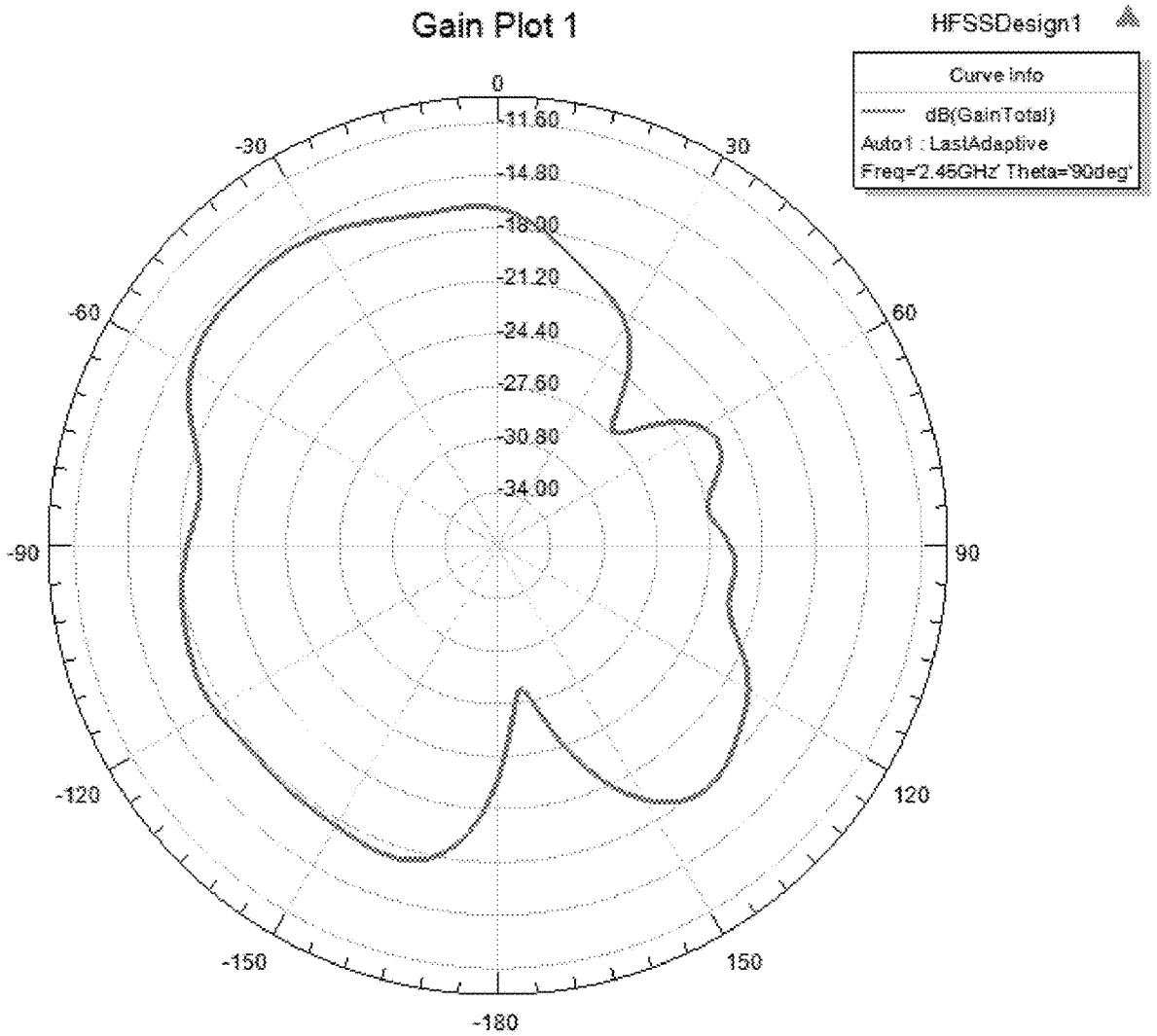
FIG. 16 is a simulated gain-phase plot for a differential antenna system, according to an example.
Figure 17:
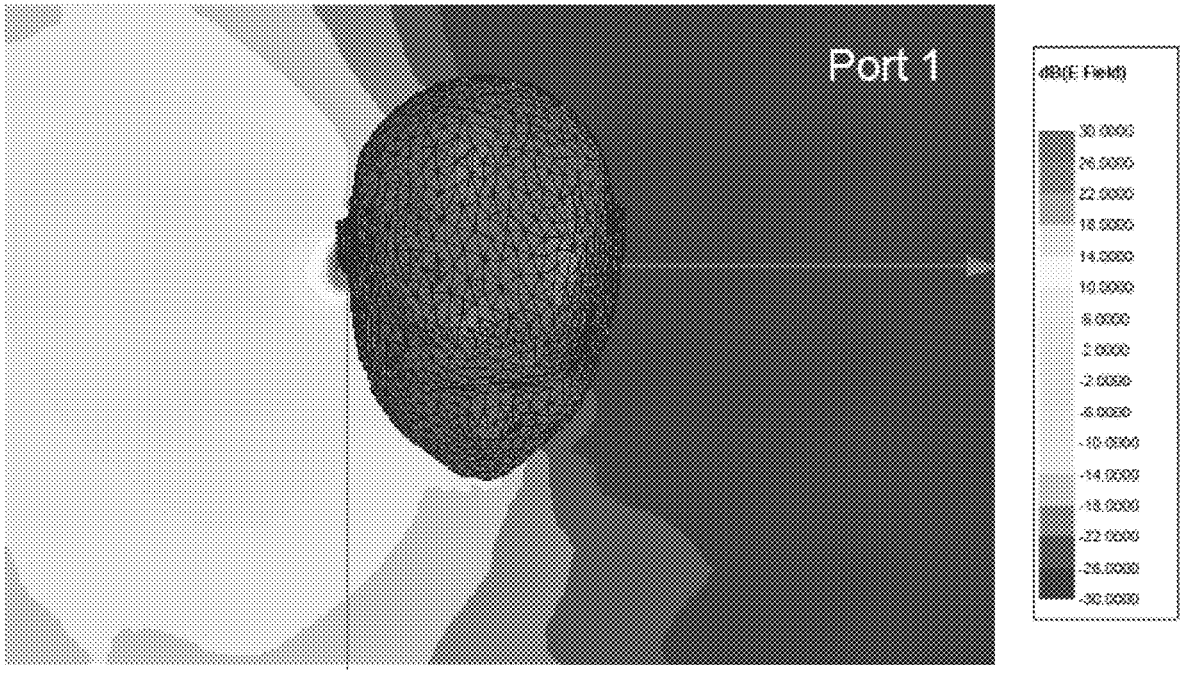
FIG. 17 is a further electric field simulation for the differential antenna system, according to an example.

Simulation results of the differential antenna system 300 are shown in FIGS. 14-17. FIGS. 14 and 17 show three-dimensional electric field simulations via a front and top view, respectively. FIG. 15 is an s-parameter reflection simulation plot of the differential antenna system 300 for a single tuneable capacitor 216 capacitance value. Similarly, FIG. 16 is a simulated gain-phase plot for a differential antenna system operating at 2.45 GHz.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

The above-described examples of the described subject matter can be implemented in any of numerous ways. For example, some aspects may be implemented using hardware, software or a combination thereof. When any aspect is implemented at least in part in software, the software code can be executed on any suitable processor or collection of processors, whether provided in a single device or computer or distributed among multiple devices/computers.

The present disclosure may be implemented as a system, a method, and/or a computer program product at any possible technical detail level of integration. The computer program product may include a computer readable storage medium (or media) having computer readable program instructions thereon for causing a processor to carry out aspects of the present disclosure.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present disclosure may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some examples, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

Aspects of the present disclosure are described herein with reference to flowchart illustrations and/or block diagrams of methods, apparatus (systems), and computer program products according to examples of the disclosure. It will be understood that each block of the flowchart illustrations and/or block diagrams, and combinations of blocks in the flowchart illustrations and/or block diagrams, can be implemented by computer readable program instructions.

The computer readable program instructions may be provided to a processor of a, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various examples of the present disclosure. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Other implementations are within the scope of the following claims and other claims to which the applicant may be entitled.

While various examples have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the examples described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific examples described herein. It is, therefore, to be understood that the foregoing examples are presented by way of example only and that, within the scope of the appended claims and equivalents thereto, examples may be practiced otherwise than as specifically described and claimed. Examples of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

What is claimed is:

1. A single-ended antenna system comprising:

an antenna arranged on or in a wearable audio device, wherein the antenna comprises:

a first curved arm electrically coupled to a first port; and a second curved arm of equal size and equal shape as the first curved arm and electrically coupled to a second port, wherein the second curved arm is rotationally positioned 180 degrees, relative to the first curved arm, about an imaginary axis perpendicular to a surface of the wearable audio device;

a radio frequency integrated circuit ("RFIC") configured to transmit or receive a radio frequency ("RF") signal via an RF port and to provide a control logic signal via a control logic port;

a fixed matching network electrically coupled to the RF port of the RFIC;

a tuneable capacitor comprising a first port, a second port electrically coupled to ground, and a tuning port electrically coupled to the control logic port of the RFIC, wherein the tuning port is configured to receive the control logic signal; and a switching circuit comprising a first port electrically coupled to the fixed matching network, a second port electrically coupled to the first port of the tuneable capacitor, and configured to transmit or receive the RF signal via one of the first port or second port of the antenna.

2. The single-ended antenna system of claim 1, wherein the fixed matching network comprises one or more capacitors and/or one or more inductors.

3. The single-ended antenna system of claim 1, wherein the fixed matching network comprises one or more microstrip traces.

4. The single-ended antenna system of claim 1, wherein the tuneable capacitor is digitally tuneable.

5. The single-ended antenna system of claim 1, wherein the tuneable capacitor is selected from a group consisting of a varicap, a switchable capacitor bank, a Micro-Electro-Mechanical Systems ("MEMS") capacitor, and combinations thereof.

6. The single-ended antenna system of claim 1, wherein the switching circuit is a double pole double throw ("DPDT") switch.

7. The single-ended antenna system of claim 1, wherein the control logic signal corresponds to a desired center frequency of the monopole antenna system.

8. The single-ended antenna system of claim 7, wherein the control logic signal further corresponds to a frequency tuning look-up table stored in the RFIC.

9. The single-ended antenna system of claim 7, wherein the desired center frequency is between 2.4 GHz and 2.5 GHz, inclusively.

10. A differential antenna system comprising:

an antenna arranged on or in a wearable audio device, wherein the antenna comprises:

a first curved arm electrically coupled to a first port; and a second curved arm of equal size and equal shape as the first curved arm and electrically coupled to a second port, wherein the second curved arm is rotationally positioned 180 degrees, relative to the first curved arm, about an imaginary axis perpendicular to a surface of the wearable audio device;

a radio frequency integrated circuit ("RFIC") configured to transmit a radio frequency ("RF") signal via an RF port and to provide a control logic signal via a control logic port;

a fixed matching network electrically coupled to the RF port of the RFIC;

a tuneable capacitor comprising a first port electrically coupled to the fixed matching network, a second port electrically coupled to ground, and a tuning port electrically coupled to the control logic port of the RFIC, wherein the tuning port is configured to receive the control logic signal; and a balun electrically coupled to the fixed matching network, the first port of the antenna, and the second port of the antenna, and configured to:

receive the RF signal via the fixed matching network;

generate a first differential signal based on the RF signal, wherein the first differential signal has a first phase;

generate a second differential signal based on the RF signal, wherein the second differential signal has a second phase, and wherein the second phase differs from the first phase by a differential phase value;

transmit the first differential signal to the first port of the antenna; and transmit the second differential signal to the second port of the antenna.

11. A differential antenna system comprising:

an antenna arranged on or in a wearable audio device, wherein the antenna comprises:

a first curved arm electrically coupled to a first port; and a second curved arm of equal size and equal shape as the first curved arm and electrically coupled to a second port, wherein the second curved arm is rotationally positioned 180 degrees, relative to the first curved arm, about an imaginary axis perpendicular to a surface of the wearable audio device;

a radio frequency integrated circuit ("RFIC") configured to receive a radio frequency ("RF") signal via an RF port and to provide a control logic signal via a control logic port;

a fixed matching network electrically coupled to the RF port of the RFIC;

a tuneable capacitor comprising a first port electrically coupled to the fixed matching network, a second port electrically coupled to ground, and a tuning port electrically coupled to the control logic port of the RFIC, wherein the tuning port is configured to receive the control logic signal; and a balun electrically coupled to the fixed matching network, the first port of the antenna, and the second port of the antenna, and configured to:

receive a first differential signal from the first port of the antenna;

receive a second differential signal from the second port of the antenna;

generate the RF signal based on the first and second differential signal; and transmit the RF signal to the RFIC via the fixed matching network.

12. The single-ended antenna system of claim 1, wherein the antenna further comprises a bridge electrically coupled to the first curved arm and the second curved arm.

13. The single-ended antenna system of claim 12, wherein the bridge has a minimum width less a minimum width of the first curved arm and/or a minimum width of the second curved arm.

14. The single-ended antenna system antenna of claim 1, wherein the first curved arm of the antenna is electrically coupled to the first port of the antenna via a first feed track, and wherein the second curved arm of the antenna is electrically coupled to the second port of the antenna via a second feed track.

15. The differential antenna system of claim 10, further comprising a bridge electrically coupled to the first curved arm and the second curved arm.

16. The differential antenna system of claim 15, wherein the bridge has a minimum width less a minimum width of the first curved arm and/or a minimum width of the second curved arm.

17. The differential antenna system of claim 10, wherein the first curved arm is electrically coupled to the first port via a first feed track, and wherein the second curved arm is electrically coupled to the second port via a second feed track.

18. The differential antenna system of claim 11, further comprising a bridge electrically coupled to the first curved arm and the second curved arm.

19. The differential antenna system of claim 18, wherein the bridge has a minimum width less a minimum width of the first curved arm and/or a minimum width of the second curved arm.

20. The differential antenna system of claim 11, wherein the first curved arm is electrically coupled to the first port of the antenna via a first feed track, and wherein the second curved arm is electrically coupled to the second port of the antenna via a second feed track.

* * * * *